United States Patent [19]

Bauman et al.

[11] 4,347,117

[45] Aug. 31, 1982

[54] DONOR SOLVENT COAL LIQUEFACTION WITH BOTTOMS RECYCLE AT ELEVATED PRESSURE

[75] Inventors: Richard F. Bauman, Houston; John W. Taunton, Seabrook; George H. Anderson, Houston; Ken L. Trachte, Baytown; Steve J. Hsia, Friendswood, all of Tex.

[73] Assignee: Exxon Research & Engineering Co., Florham Park, N.J.

[21] Appl. No.: 203,410

[22] Filed: Nov. 3, 1980

Related U.S. Application Data

[63] Continuation-in-part of Ser. No. 106,068, Dec. 20, 1979, abandoned.

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,617,465 | 11/1971 | Wolk et al. | 208/8 LE |
| 3,884,794 | 5/1975 | Bull et al. | 208/8 LE |
| 4,022,680 | 5/1977 | Maa | 208/8 LE |
| 4,189,374 | 2/1980 | Kirby et al. | 208/8 LE |
| 4,190,518 | 2/1980 | Giannetti et al. | 208/8 LE |
| 4,203,823 | 5/1980 | Carr et al. | 208/10 |
| 4,211,631 | 7/1980 | Carr et al. | 208/8 LE |

OTHER PUBLICATIONS

"E.D.S. Coal Liq. Process Development", Phase IV, FE-2893-25, Dec. 31, 1978, pp. 41, 42 and 48-50; FE-2893-29, Mar. 31, 1979, pp. 21, 22 and 33-35.

"E.D.S. Coal Liq. Process Development", Phase IV, FE-2893-24, Jun. 30, 1979, pp. 6-7 and 10; FE-28-93-35, pp. 38-56, 59-60 and 85-95.

*Primary Examiner*—Delbert E. Gantz
*Assistant Examiner*—William G. Wright
*Attorney, Agent, or Firm*—Wayne Hoover

[57] ABSTRACT

An improved process for liquefying solid carbonaceous materials wherein increased naphtha yields are achieved by effecting the liquefaction at a pressure within the range from about 1750 to about 2800 psig in the presence of recycled bottoms and a hydrogen-donor solvent containing at least 0.8 wt % donatable hydrogen. The liquefaction is accomplished at a temperature within the range from about 700° to about 950° F. The coal:bottoms ratio in the feed to liquefaction will be within the range from about 1:1 to about 5:1 and the solvent or diluent to total solids ratio will be at least 1.5:1 and preferably within the range from about 1.6:1 to about 3:1. The yield of naphtha boiling range materials increases as the pressure increases but generally reaches a maximum at a pressure within the range from about 2000 to about 2500 psig.

25 Claims, 7 Drawing Figures

FIGURE I

DONOR SOLVENT COAL LIQUEFACTION WITH BOTTOMS RECYCLE AT ELEVATED PRESSURE

The Government of the United States of America has rights in this invention pursuant to Contract No. DE-FCol-77ET10069 (formerly Contract No. EF-77-A-01-2893) awarded by the United States Energy Research and Development Administration, now the U.S. Department of Energy.

CROSS-REFERENCE TO RELATED APPLICATIONS

This application is a continuation-in-part of Ser. No. 106,068 filed in the U.S. Patent and Trademark Office on Dec. 20, 1979, now abandoned.

BACKGROUND OF THE INVENTION

This invention relates to an improved process for converting coal or similar solid carbonaceous materials. More particularly, this invention relates to an improved process for liquefying coal and similar carbonaceous substances.

As is well known, coal has long been used as a fuel in many areas. For several reasons, such as handling problems, waste disposal problems, pollution problems and the like, coal has not been a particularly desirable fuel from the ultimate consumers point of view. Moreover, coal cannot be used directly in areas where a liquid or gaseous fuel is required. As a result, oil and gas have enjoyed a dominant position, from the standpoint of fuel sources throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously and which will permit use in those areas where liquid or gaseous fuels are normally required.

To this end, several processes wherein coal is either liquefied and/or gasified have been proposed heretofore. Of these, the processes wherein coal is liquefied appear to be more desirable since a broader range of products is produced and these products are more readily transported and stored.

Of these several liquefaction processes which have been heretofore proposed, those processes wherein coal is liquefied in the presence of a solvent or diluent, particularly a hydrogen-donor solvent or diluent, and a hydrogen-containing gas appear to offer the greater advantages. In these processes, liquefaction is accomplished at elevated temperatures and pressures and hydrocarbon gases are invariably produced as by-products. For the most part, however, these processes result in high relative yields of higher boiling point liquids; i.e., products boiling in the fuel oil and vacuum gas oil ranges. The bulk of the products obtained from these processes, then, are at best substitutes for coal in applications where coal could be used directly. Moreover, and while some lighter products are produced there has, heretofore, been little control over the product distribution or the total amount of liquids actually produced. The need, therefore, for a liquefaction process which will increase the yield of liquid products and provide better control over the relative distribution of motor gasoline, jet fuel and heavier oils is believed to be readily apparent.

SUMMARY OF THE INVENTION

It has now been discovered that the foregoing and other disadvantages of the prior art processes can be reduced with the method of the present invention and an improved liquefaction process provided thereby. It is, therefore, an object of this invention to provide an improved liquefaction process. It is another object of this invention to provide such a liquefaction process wherein the yield of liquid products is increased. It is still a further object of this invention to provide such an improved liquefaction process wherein the relative yield of lighter and heavier boiling materials can be controlled. The foregoing and other objects and advantages will become apparent from the description set forth hereinafter and from the drawing appended thereto.

In accordance with the present invention, the foregoing and other objects and advantages are accomplished by liquefying a coal or similar solid carbonaceous material in the presence of a hydrogen-donor solvent at elevated pressures and temperatures. As pointed out more fully hereinafter, the total liquid yield and the relative amount of lower boiling materials can be controlled at any given set of liquefaction conditions primarily by controlling the pressure at which liquefaction is accomplished, provided the amount of donatable hydrogen in the solvent, the solvent to solid carbonaceous material ratio and the concentration of naphthenic components in the solvent are maintained above critical limits.

DETAILED DESCRIPTION OF THE INVENTION

Figure 1:
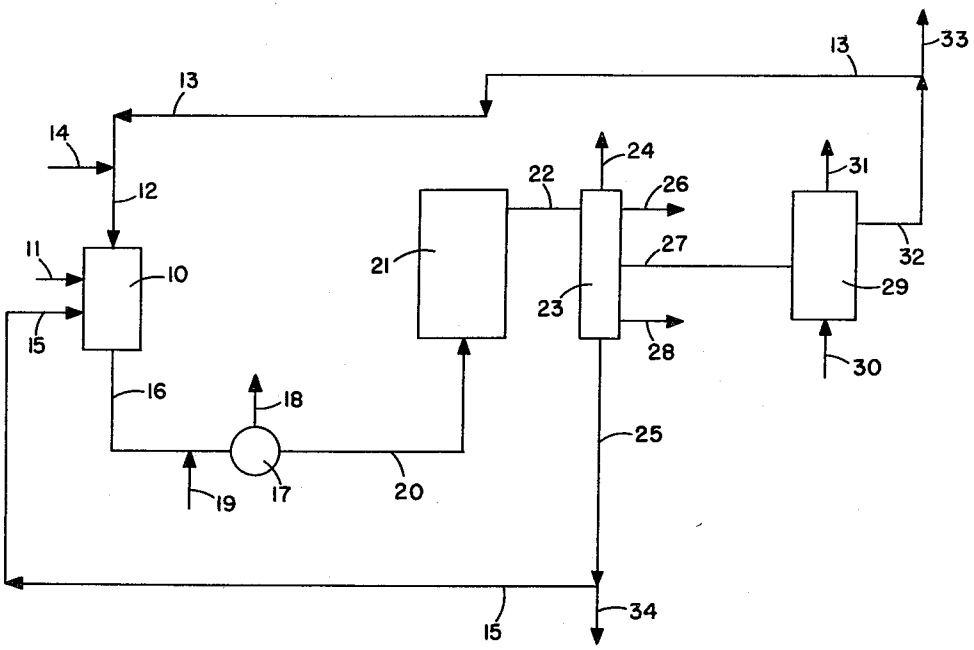
FIG. 1 is a schematic flow diagram of a process within the scope of the present invention.

As indicated, supra, the present invention relates to an improved process for liquefying coal and similar solid carbonaceous materials wherein total liquid yield and the relative distribution of lighter boiling and heavier boiling liquid products is controlled by controlling the pressure at which the liquefaction is accomplished. As indicated more fully hereinafter, it is critical to the present invention that the liquefaction be accomplished in the presence of a solvent containing at least about 0.8 wt % donatable hydrogen during liquefaction; that the solvent:solid carbonaceous material ratio be at least about 0.8:1 and that the concentration of naphthenic (saturated) components in the solvent be at least about 10 wt %.

In general the method of the present invention can be used to liquefy any solid carbonaceous material which can, effectively, be hydrogenated and liquefied. The method of this invention is particularly useful in the liquefaction of coal and may be used to liquefy any of the coals known in the prior art including anthracite, bituminous coal, subbituminous coal, lignite, peat, brown coal and the like.

In general, the solid carbonaceous material will be ground to a finely divided state. The particular particle size, or particle size range, actually employed, however, is not critical to the invention and, indeed, essentially any particle size can be employed. Notwithstanding this, generally, the solid carbonaceous material which is liquefied in accordance with this invention will be ground to a particle size of less than ¼" and preferably to a particle size of less than about 8 mesh (NBS sieve size).

After the solid carbonaceous material has been sized the same will then be slurried with a hydrogen-donor solvent or diluent containing at least about 0.8 wt % donatable hydrogen and at least about 15 wt % naphthenic components. Normally, the ratio of solvent or diluent to coal (on a moisture-free basis) in the slurry will be within the range from about 0.8:1 to about 10:1 on a weight basis. Ratios in the higher portion of this range will, of course, be required at the higher bottoms recycle rates to ensure that the slurry, when bottoms are incorporated, can be transported by pumping or the like.

In general, any of the solvents or diluents known in the prior art to contain at least about 0.8 wt % of donatable hydrogen based on the weight of total solvent and at least 10 wt % naphthenic (saturated components can be used in the improved process of this invention. Suitable solvents include mixtures of one or more hydrogen-donor compounds and one or more naphthenic components. Compounds which will donate hydrogen during liquefaction are believed well known in the prior art and many are described in U.S. Pat. No. 3,867,275. These include the indanes, the dihydronaphthalenes, the $C_{10}$–$C_{12}$ tetra-hydronaphthalenes, the hexahydrofluorenes, the dihydro-, tetrahydro-, hexahydro- and octahydrophenanthrenes, the $C_{12}$–$C_{13}$ acenaphthenes, the tetrahydro-, hexahydro- and decahydropyrenes, the di-, tetra- and octahydroanthracenes, and other derivatives of partially saturated aromatic compounds. Suitable naphthenic compounds include the completely saturated compounds corresponding to the aforementioned hydroaromatic compounds and other completely saturated cyclic and heterocyclic hydrocarbons. Particularly effective mixed solvents include hydrogenated creosote oil and solvents derived from the liquefaction of coal, particularly distillate fractions having an initial boiling point within the range from about 350° F. to about 425° F., and a final boiling point within the range from about 700° F. to about 900° F. which are hydrogenated to contain at least 25 wt % of hydrogen-donor species.

After the solid carbonaceous material has been slurried, the slurry will then be subjected to liquefaction at a temperature within the range from about 700 to about 950° F. and a pressure within the range from about 1750 to about 2800 psig. The essence of the present invention resides in the discovery that for any given solid carbonaceous material and particularly for any given coal, increased pressure increases the total yield of liquid products and the yield of naphtha boiling range liquids when a hydrogen-donor solvent containing at least about 0.8 wt % donatable hydrogen and at least about 10 wt % naphthenic compounds is used during liquefaction and that this increased yield of total liquid products and of naphtha boiling range materials is surprisingly increased as liquefaction pressure is increased. For any given solid carbonaceous material, therefore, the total liquid yield and the relative yield of naphtha boiling range material to higher boiling range materials can be controlled by controlling the pressure at any given reactor holding time and temperature when a suitable solvent is used at an effective concentration.

In general, the effect of pressure and the solvent:solid carbonaceous material ratio rate required for maximum naphtha yield will vary from one solid carbonaceous material to another. Nonetheless, it has been found that the naphtha yield is greater than would heretofore have been expected for all solid carbonaceous materials at pressures above about 1750 psig when the solvent:solid carbonaceous material ratio is at least 0.8:1 and a suitable solvent is used. Moreover, it has been found that the naphtha yield is expressed as a function of operating variables by the following equation:

$$Y_{naphtha} = k_1(1 - e^{-k_2\phi}) + C_1\left(\frac{B}{SC}\right) + C_2 + k_3(1 - e^{-k_4\phi})PC_3N$$

wherein:

$Y_{naphtha}$ = the yield of $C_4$-400° F. boiling range naphtha in wt % based on solid carbonaceous material;

$k(1-e^{-k_2\phi})$ = the yield of naphtha via conversion of solid carbonaceous material; $k_1$ and $k_2$ are reaction rate constants which vary with the solid carbonaceous material and $\phi$ is the holding time at liquefaction conditions;

$C_1(B/SC)$ = the yield of naphtha via conversion of bottoms; $C_1$ is a constant which varies with solid carbonaceous material and B/SC is the ratio of recycle bottoms to fresh solid carbonaceous material fed to liquefaction;

$k_3(1-e^{-k_4\phi})$ = yield of naphtha via conversion of solvent; $k_3$ and $k_4$ are reaction rate constants which vary with solid carbonaceous material and $\phi$ is the holding time at liquefaction conditions;

P = the pressure during liquefaction;

$C_3$ = a constant which varies with the particular solid carbonaceous material; and N = concentration of naphthenic components in the solvent.

As previously indicated, the essence of the present invention resides in the discovery of what may be a synergistic relationship between naphtha yield and increased liquefaction pressure when a solvent containing at least 0.8 wt % donatable hydrogen and at least 10 wt % naphthenic components is used. Maximum naphtha yields are realized when a portion of the bottoms product is recycled to the liquefaction zone. Moreover, and as discussed more fully hereinafter, bottoms recycle is essential to maintenance of a solvent balance when relatively high naphtha yields are achieved. As used in this disclosure, bottoms means the heavier material remaining after the gaseous and liquid products from liquefaction have been separated. Generally, the bottoms will have an initial boiling point within the range from about 900 to about 1100° F. and will contain unconverted solid carbonaceous material, higher boiling converted material and mineral matter.

In general, it has been found that the naphtha yield and the total liquid yield increase with pressure at pressures above a critical pressure of about 1750 psig and this increase continues until a maximum naphtha yield is reached at pressures within the range from about 2000 psig to about 2500 psig. As previously indicated, the critical pressure for any given solid carbonaceous material will vary slightly but, in general, the critical pressure will be a pressure within the range from about 1700 to about 1800 psig. Similarly, the pressure at which maximum, naphtha yield is achieved will vary from solid carbonaceous material to solid carbonaceous material but will, generally, be realized at pressures within the range from about 2000 to about 2500 psig. There is, then, no incentive to operate at pressures significantly above about 2800 psig. Moreover, liquefaction reactor operations below about 2800 psig are preferred to ensure steady state operation in a solvent balance mode. In this regard it is important that sufficient 400°–800° F. boiling range material be produced to ensure that extraneous solvent will not be required to form the slurry subjected to reactor conditions.

As indicated previously, the liquefaction will, generally, be accomplished at a temperature within the range from about 700° to about 950° F. and at a pressure within the range from about 1750 to about 2800 psig. Any number of liquefaction stages or zones may be used to effect the liquefaction. The total nominal holding time will, generally, range from about 10 to about 200 minutes although, when multiple stages are employed, total nominal holding times in excess of 200 minutes may be employed.

In general, the liquefaction will result in the production of a gaseous product, a liquids product and a normally solid bottoms product. After liquefaction these products may be separated into respective phases using conventional techniques. For example, the gaseous product may be simply flashed overhead and the liquid and solids then separated using filtration, centrifugation or distillation. Of these, distillation is preferred.

After separation, the gaseous product may be upgraded to a pipeline gas or the same may be burned to provide energy for the liquefaction process. Alternatively, all or a portion of the gaseous product may be reformed to provide hydrogen for the liquefaction process or sold as fuel.

The liquids product may be fractionated into essentially any desired product distribution and/or a portion thereof may also be used directly as a fuel or upgraded using conventional techniques. Similarly, a portion of the liquid product may be separated and used as a solvent or diluent in the liquefaction process of this invention. When this is done, this portion of the liquid product will be hydrogenated to increase the amount of donatable hydrogen and naphthenic components therein prior to use as a solvent or diluent. Generally, a naphtha fraction will be recovered and the naphtha fraction will be further processed to yield a high-quality gasoline or similar fuel boiling in the naphtha range.

Finally, in accordance with the improvement of this invention and in a preferred embodiment thereof, at least a portion of the bottoms will be withdrawn and recycled directly to the liquefaction zone. Such recycle may be accomplished simply by combining the recycle bottoms with the coal during the slurry preparation. In general, sufficient bottoms will be recycled to the liquefaction zone and combined with coal in the liquefaction feed to provide a coal:bottoms ratio within the range from about 0.5:1 to about 5:1. The remaining portion of the bottoms may then be burned directly as a fuel to produce energy for the process, gasified to produce either an intermediate BTU fuel gas or hydrogen for use in the liquefaction process or simply discarded. In general, the bottoms will contain from about 50 to about 75 wt % carbon.

PREFERRED EMBODIMENT

In a preferred embodiment of the present invention, coal will be liquefied at a temperature within the range from about 800° to about 880° F. and the pressure will be controlled within the range from about 2000 to about 2500 psig to achieve maximum naphtha yields and to control the relative yield of naphtha boiling range liquid product. In the preferred embodiment the coal will be slurried with a solvent derived from the coal liquefaction liquid product and the solvent will be hydrogenated such that the solvent contains from about 1.2 to about 1.8 wt % donatable hydrogen and from about 20 to about 40 wt % naphthenic components. The solvent to coal ratio in the slurry will be within the range from about 1:1 to about 5:1. In a most preferred embodiment, bottoms will be recycled in an amount sufficient to provide a coal:bottoms ratio in the slurry within the range from about 1:1 to about 2:1. The nominal holding time during liquefaction will be within the range from about 40 to about 140 minutes.

It is believed that the invention will be better understood by reference to attached FIG. 1 which illustrates a particularly preferred embodiment. Referring then to FIG. 1, a finely divided coal or similar solid carbonaceous material is introduced into mixing vessel 10 through line 11 and slurried with a hydrogen-donor solvent or diluent introduced through line 12. In a preferred embodiment, the solvent will be derived from the solid being subjected to liquefaction, will by hydrogenated to produce a solvent containing at least about 50 wt % hydrogen-donor species and from about 20 to about 40 wt % naphthenic components and will be recycled to the mixing vessel through line 13. During startup, however, or when a recycle solvent is not employed, any of the known useful hydrogen-donor solvents or diluents may be introduced into line 12 through line 14. During startup, it is not essential that the solvent contain naphthenic components but when an extraneous solvent is used to maintain operation it is essential that the solvent contain at least about 10 wt % naphthenic components.

In mixing vessel 10, the coal is also mixed, in the preferred embodiment, with recycle bottoms introduced through line 15. In the most preferred embodiment, the coal and recycle bottoms will be combined in a ratio within the range from about 1:1 to about 2:1. The coal and recycled bottoms will be combined with sufficient solvent to produce a slurry wherein the solvent to coal ratio is within the range from about 1:1 to about 5:1.

The slurry is withdrawn from mixing vessel 10 through line 16 and passed through preheater 17. In the preheater 17, the slurry will, generally, be preheated to the desired temperature. When desired, and particularly when the solid carbonaceous material has not been previously dried, steam will be flashed overhead through line 18.

In general, the slurry of solid carbonaceous material will be combined with molecular hydrogen. In a preferred embodiment, the molecular hydrogen will be added prior to preheating through line 19. This is not, however, critical and the hydrogen could be added downstream of preheater 17 or directly into the liquefaction vessel. In any case, the hydrogen will be introduced after the steam is flashed overhead. In the preferred embodiment, the hydrogen will be produced either by the steam reforming of product gas from the liquefaction or by gasification of the liquefaction bottoms or coal, all in accordance with conventional technology. In general, sufficient hydrogen will be introduced to provide from about 2 to about 10 wt %, preferably from about 3 to about 8 wt % molecular hydrogen based on dry, solid carbonaceous material.

The slurry is withdrawn from the preheater through line 20 and passed directly to liquefaction vessel 21. In the liquefaction vessel 21, the solid carbonaceous material is at least partially liquefied and, generally, at least partially gasified in the absence of an added catalyst. Preferably, the liquefaction vessel will be sized so as to provide a nominal holding time within the range from about 40 to about 140 minutes and while a single vessel has been illustrated, a plurality of vessels may be employed. Also, the temperature within the liquefaction zone will, preferably, be within the range from about 800° to about 880° F. and the pressure will preferably be controlled within the range from about 2000 to about 2500 psig. As previously indicated, the actual pressure employed will depend primarily upon the relative naphtha yield desired and the particular solid carbonaceous material subjected to liquefaction.

In the embodiment illustrated, the combined product from liquefaction vessel 21 is withdrawn through line 22 and passed to separating means 23. In the embodiment illustrated, the separating means may be a combined atmospheric and vacuum distillation column wherein gaseous products and products boiling below the naphtha boiling range are withdrawn overhead through line 24 while unconverted solid carbonaceous material and mineral matter and converted materials boiling at a temperature above about 950° to about 1050° F. is withdrawn through line 25. The liquid product is then fractionated into desired fractions and in the embodiment illustrated, a naphtha product boiling within the range from about 150 to about 400° F. is withdrawn through line 26, a material boiling within the range from about 400° to about 800° F. is withdrawn through line 27 and a heavier fraction boiling from about 800° to about 1100° F. is withdrawn through line 28.

In general, the overhead, gaseous material will comprise gaseous and lower boiling hydrocarbons, steam, carbon oxides, acid gases such as $SO_2$ and $H_2S$ and any ammonia which may have been produced during liquefaction. This stream may be scrubbed and further divided to yield a high BTU gas and lighter hydrocarbons. The naphtha stream may be subjected to further upgrading to yield a good quality gasoline and the heavier stream withdrawn through line 28 may be upgraded to produce a heavy fuel oil or cracked and reformed to yield a gasoline boiling fraction. Generally, the solvent boiling range material or at least a portion thereof will be catalytically hydrogenated to increase the concentration of hydrogen-donor species and the concentration of naphthenic components and recycled to mixing vessel 10 as a solvent or diluent.

As indicated, supra, the particular separation scheme employed is not critical to the present invention and, indeed, any of the separation techniques known in the prior art could be used to effect a separation of the gaseous, liquid and solid products. For example, the gaseous product could be flashed directly after liquefaction and the liquid-solid mixture then subjected to separation via distillation, filtration, centrifugation or the like. In any case, however, a bottoms product containing unreacted coal, mineral matter and high boiling hydrocarbons will be available for recycling in accordance with the preferred embodiment of this invention. Similarly, a solvent boiling range material can be recovered for recycle as the solvent or diluent.

In the preferred embodiment, the solvent fraction withdrawn through line 27 will be hydrogenated before the same is recycled to mixing vessel 10. Preferably the hydrogenation will be accomplished catalytically at conditions known to be effecive for this purpose in the prior art. In the embodiment illustrated, the hydrogenation is accomplished in hydrogenation vessel 29 with molecular hydrogen introduced through line 30. The hydrogen actually used may be from any source, but in a preferred embodiment will be produced either through the steam reforming of at least a portion of the gaseous product from liquefaction or by gasification of at least a portion of the bottoms or of coal. In the embodiment illustrated, unreacted hydrogen and the gaseous products of hydrogenation are withdrawn through line 31. When desired, this gaseous product may be treated to recover recycle hydrogen. Also in the embodiment illustrated, the hydrogenation product is withdrawn through line 32. In those cases where the amount of liquid withdrawn through line 32 exceeds the amount of solvent required during liquefaction, any excess may be withdrawn through line 33 and the remainder recycled to mixing vessel 10 through lines 13 and 12.

Normally the hydrogenation will be accomplished at a temperature within the range from about 600° F. to about 950° F., preferably 650° F. to 800° F., and at a pressure within the range from about 650 to about 2000 psig, preferably 1000 to 1500 psig. The hydrogen treat rate during the hydrogenation generally will be within the range from about 1000 to about 10,000 SCF/bbl. Any of the known hydrogenation catalysts may be employed, but a "nickel-moly" catalyst is most preferred.

In accordance with the preferred embodiment of the present invention, the bottoms product withdrawn through line 33 will be divided and a portion thereof recycled to mixing vessel 10 through line 15. The remaining bottoms may then be processed in accordance with conventional technology such as coking and gasification or the same may be burned directly. The remaining portion is withdrawn through line 34.

Having thus broadly described the present invention and a preferred embodiment thereof, it is believed that the same will become more apparent by reference to the following examples. It will be appreciated, however, that the examples are presented solely for purposes of illustration and should not be construed as limiting the invention.

EXAMPLE 1

In this example, a series of runs were completed in a 50 lb/day continuous unit at 3 different pressures. In each run, a Pittsburgh seam coal from the Ireland mine was used as the solid carbonaceous material and a hydrogenated recycle liquid having an initial boiling point of about 400° F. and a final boiling point of about 800° F. and containing from about 40 to about 45 wt % hydrogen donor species was used as the diluent. The concentration of naphthenic components varied in each run. Also in each run, the solvent:solids ratio was 1.6:1; the temperature of liquefaction in each run was 840° F. and the nominal holding time in the continuous liquefaction reactor was 100 minutes. After steady state was achieved, the total liquid yield, the percent naphtha boiling range material in the total liquid product and the naphtha yield based on dry coal were determined. For convenience, the pressures, saturate concentration and results obtained are tabulated below and for purposes of easy comparison, the naphtha yields are plotted in FIGS. 2 and 3 and the total liquid yield is plotted in FIG. 4.

| Run No. | Pressure | Wt % Naph Components in Solvent | Total Liq Yld | Wt % Naph | Lbs Naph/100# Dry Coal |
|---|---|---|---|---|---|
| 1 | 1000 | 9.2 | 35.0 | 65.0 | 20.4 |
| 2 | 1500 | 12.1 | 42.5 | 68.8 | 26.5 |
| 3 | 2500 | 15.4 | 48.0 | 71.2 | 31.0 |

EXAMPLE 2

In this example, runs 1 and 3 of Example 1 were repeated except that in each run the coal was combined with bottoms produced during the run in a ratio of 2:1 and the solvent to solids ratio varied from 1.05 to 1.6, and the solvent contained a slightly higher concentration of unsaturates in both runs. At steady state, the total liquid yield, the wt % naphtha in the total liquids and the naphtha yield based on dry coal were determined. The pressures, saturates concentration and results obtained are tabulated below and for purposes of comparison with the results of Example 1, certain results are shown graphically in FIGS. 2, 3 and 4. To facilitate direct comparison, however, the results shown in the figures have been adjusted to compensate for the different solvent:total solids ratios used in the two examples.

| Run No. | Pressure | Wt % Naph Components in Solvent | Total Liq Yld | Wt % Naph | Lbs Naph/100# Dry Coal |
|---|---|---|---|---|---|
| 1 | 1500 | 11.1 | 40.5 | 76.5 | 26.0 |
| 2 | 2500 | 17.2 | 55.3 | 88.4 | 42.6 |

Figure 2:
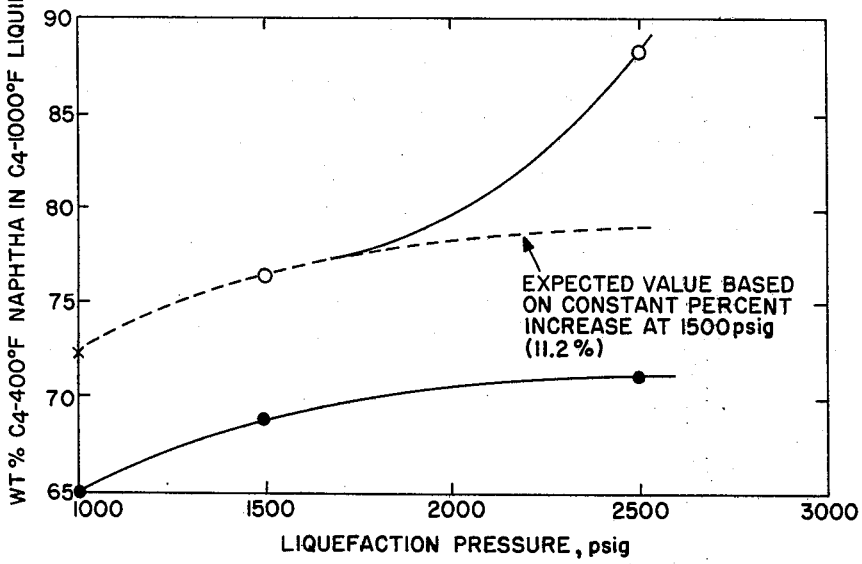
FIG. 2 is a plot showing the amount of naphtha as a percent of total liquids produced as a function of liquefaction pressure, with and without bottoms recycle, when a Pittsburgh seam coal is liquefied.
Figure 3:
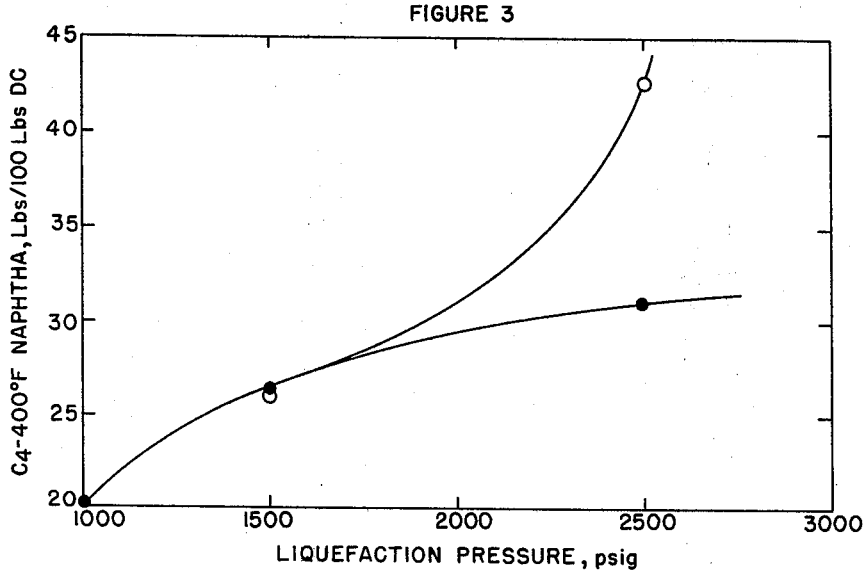
FIG. 3 is a plot showing the amount of naphtha produced as a percentage of the dry coal feed as a function of pressure, with and without bottoms recycle, when a Pittsburgh seam coal is liquefied.
Figure 4:
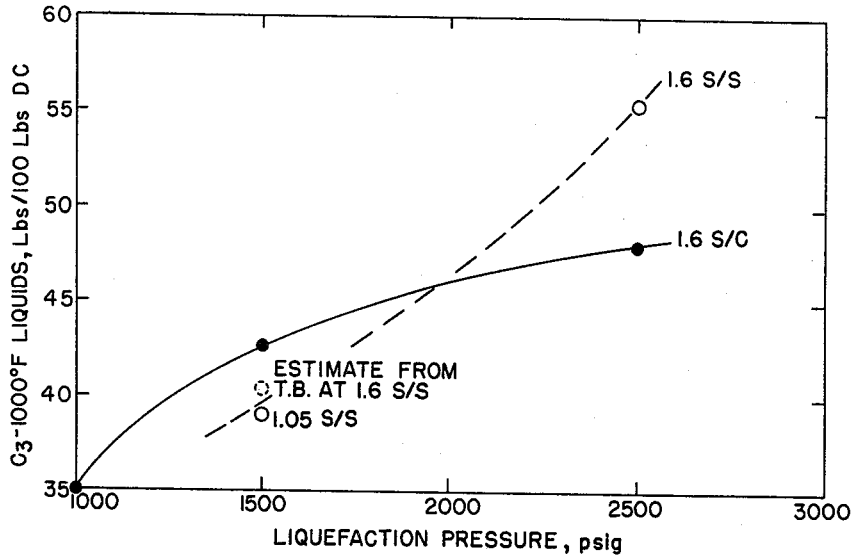
FIG. 4 is a plot showing the total ($C_3$-1000° F.) liquid yield as a function of liquefaction pressure, with and without bottoms recycle, when a Pittsburgh seam coal is liquefied.

As will be apparent from FIGS. 2, 3 and 4 the naphtha yield with bottoms recycle at 2500 psig, using a solvent containing at least 10 wt % naphthene components, is significantly higher than the expected yield and the curves suggest a critical pressure between 1500 and 2000 psig. Similarly, the total liquid yield with bottoms recycle at 2500 psig is significantly higher than expected and the plot again reflects a critical pressure within the range of 1500 to 2000 psig. This data, in combination with other data, suggests that the critical pressure is about 1750 psig.

EXAMPLE 3

In this example, two runs were completed in the equipment used in the previous examples using an Illinois #6 coal from the Monterey No. 1 mine as the solid carbonaceous material and one run was completed in a larger unit. The pressure was 1500 and 2500 psig in the runs completed in the smaller unit and 2000 psig in the run completed in the larger unit. The temperature in each run was about 840° F. In each run the coal was slurried with a recycle solvent derived from the coal being liquefied and containing 40–46 wt % donatable hydrogen species and varying concentrations of naphthenic components at a solvent:total solids ratio of 1.6:1. The nominal residence time in each run was about 60 minutes. After steady state was achieved in the continuous liquefaction reactor, the total liquid yield, the wt % naphtha, based on total liquids, and the naphtha yield based on dry coal were determined. For convenience, the pressures, saturates concentration and results obtained are tabulated below and certain results are shown graphically in FIGS. 5, 6 and 7.

| Run No. | Pressure | Wt % Naph Components in Solvent | Total Liq Yld | Wt % Naph | Lbs Naph/100# Dry Coal |
|---|---|---|---|---|---|
| 1 | 1500 | — | 38.0 | 69 | 26.8 |
| 2 | 2000 | 15.5 | 37.5 | 76 | 26.1 |
| 3 | 2500 | 12.6 | 46.8 | 56 | 24.6 |

EXAMPLE 4

In this example, three runs were completed at different pressures using an Illinois #6 coal from the Monterey No. 1 mine as the solid carbonaceous material. The runs were completed in the same smaller equipment used in the previous examples. The runs in this example were similar to those completed in Example 3, but the coal was combined with bottoms produced during the run in a 1:1 ratio during the first two runs and in a 2:1 ratio in the third run and solvents containing slightly higher concentrations of naphthenic components were used. A recycle solvent produced in the same manner as that used in Example 3 was used in these runs. The solvent:coal ratio in all three runs was 1.6:1 and, as a result, the solvent:total solids ratio varied at the different coal:bottoms ratios. The runs were completed at 840° F. and 60 minutes nominal holding time. At steady state, the total liquid yield, the fractional naphtha yield and the naphtha yield based on dry coal were determined. These results are tabulated below with pressure and saturates concentration and results, adjusted to correct for the varying solvent to solids and coal to bottoms ratios, are shown in FIGS. 5, 6 and 7.

| Run No. | Pressure | Wt % Naph Components in Solvent | Total Liq Yld | Wt % Naph | Lbs Naph/100# Dry Coal |
|---|---|---|---|---|---|
| 1 | 1500 | 16.2 | 44.5 | 82.0 | 32.7 |
| 2 | 2000 | 20.4 | 48.8 | 87.5 | 38.2 |
| 3 | 2500 | 15.1 | 51.3 | 77 | 35.8 |

Figure 5:
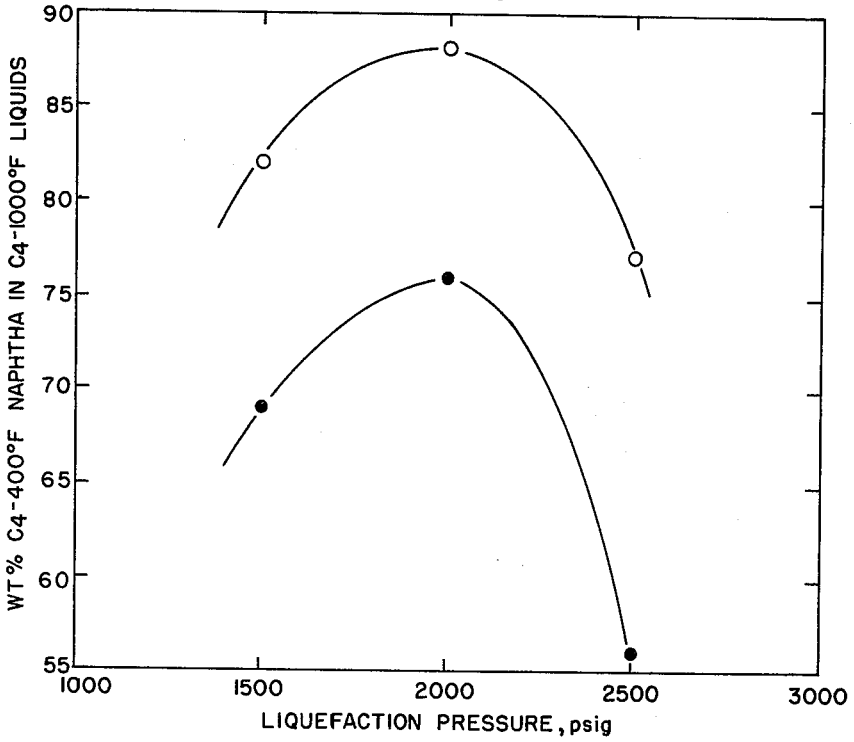
FIG. 5 is a plot showing the naphtha yield as a fraction of total liquids and as a function of pressure with and without bottoms recycle, when an Illinois seam coal is liquefied.
Figure 6:
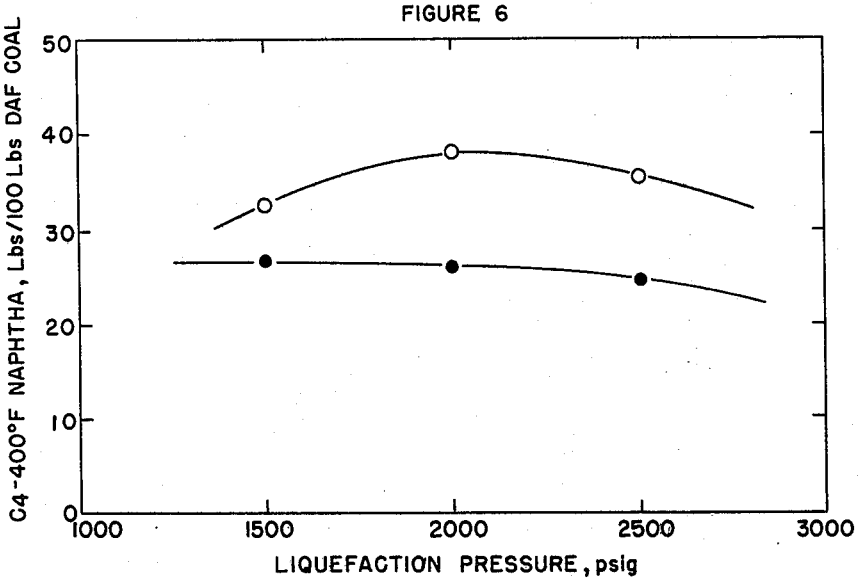
FIG. 6 is a plot showing the naphtha yield as a percent of dry coal and as a function of pressure, with and without bottoms recycle, when an Illinois seam coal is liquefied.
Figure 7:
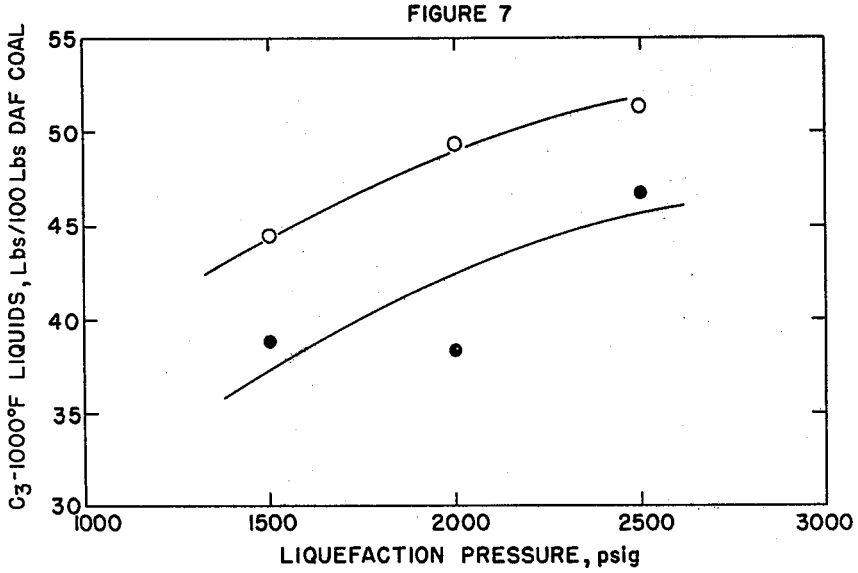
FIG. 7 is a plot showing total liquid yield as a function of pressure, with and without bottoms recycle, when an Illinois seam coal is liquefied.

As will be apparent from FIGS. 5, 6 and 7 both the total liquids and naphtha yields were higher than expected at pressure above about 2000 psig when bottoms recycle and a solvent containing at least 15 wt % naphthenic components was used. Moreover, the naphtha yield was effectively constant at pressures ranging from about 2000 psig to about 2500 psig. This, then, permits continuous operation at maximum naphtha yields, when operating within this range of pressure, and permits the maintenance of "solvent balance."

Having thus described and illustrated the invention, what is claimed is:

1. A process for liquefying coal and similar solid carbonaceous materials comprising the steps of:

(a) contacting the solid carbonaceous material, a solvent or diluent containing at least 0.8 wt % donatable hydrogen and at least about 10 wt % naphthenic components at a temperature within the range from about 700° to about 950° F. and at a pressure within the range from about 1750 to about 2800 psig;

(b) maintaining the contacting of step (a) for a nominal period of time sufficient to liquefy at least a portion of the solid carbonaceous material, (c) separating the effluent resulting from the contacting of step (a) after the contacting has been continued for a sufficient period of time to liquefy at least a portion of the solid carbonaceous material thereby yielding a normally gaseous product, a normally liquid product and a bottoms product; and (d) separating a naphtha boiling range product and a heavier boiling product from the liquid.

2. The process of claim 1 wherein the weight ratio of solvent to solid carbonaceous material is at least 0.8:1.

3. The process of claim 1 wherein the hydrogen-donor solvent is a distillate fraction separated from the liquid product.

4. The process of claim 3 wherein the distillate fraction has an initial boiling point within the range from about 350° to about 425° F. and a final boiling point within the range from about 700° to about 900° F.

5. The process of claim 4 wherein the distillate fraction has an initial boiling point of about 400° F. and a final boiling point of about 800° F.

6. The process of claim 4 wherein said distillate fraction is hydrogenated to produce a solvent or diluent containing at least about 25 wt % hydrogen-donor species and at least 15 wt % naphthenic components.

7. The process of claim 6 wherein said distillate fraction is hydrogenated to produce a solvent or dilluent containing from about 40 to about 50 wt % hydrogen-donor species or higher and from about 20 to about 40 wt % naphthenic components.

8. The process of claim 1 wherein the hydrogen-donor solvent contains 1.2 to about 3.0 wt % donatable hydrogen at the liquefaction conditions.

9. The process of claim 1 wherein the ratio of solvent or diluent to solid carbonaceous material is within the range from about 0.8:1 to about 10:1.

10. The process of claim 1 wherein said solid carbonaceous material is a bituminous coal.

11. The process of claim 1 wherein said solid carbonaceous material is a subbituminous coal.

12. The process of claim 1 wherein the pressure in Step (a) is within the range from about 2000 to about 2500 psig.

13. A process for liquefying coal and similar solid carbonaceous materials comprising the steps of:

(a) contacting the solid carbonaceous material, a solvent or diluent containing at least 0.8 wt % donatable hydrogen and recycle bottoms and at least about 10 wt % naphthenic components at a temperature within the range from about 700° to about 950° F. and at a pressure within the range from about 1750 to about 2800 psig;

(b) maintaining the contacting of step (a) for a nominal period of time sufficient to liquefy at least a portion of the solid carbonaceous material, (c) separating the effluent resulting from the contacting of step (a) after the contacting has been continued for a sufficient period of time to liquefy at least a portion of the solid carbonaceous material thereby yielding a normally gaseous product, a normally liquid product and a bottoms product;

(d) recycling a sufficient portion of the bottoms to provide a bottoms:solid carbonaceous material ratio in the feed to step (a) within the range from about 0.5:1 to about 5:1; and (e) separating a naphtha boiling range product and a heavier boiling product from the liquid.

14. The process of claim 13 wherein the recycled bottoms are slurried with the coal prior to liquefaction.

15. The process of claim 14 wherein the amount of bottoms recycled is sufficient to provide a bottoms:coal ratio within the range from about 0.5:1 to about 5:1.

16. The process of claim 15 wherein the solvent:coal ratio in the slurry is at least 0.8:1.

17. The process of claim 15 wherein the solvent:coal ratio in the slurry is within the range from about 1.1:1 to about 5:1.

18. The process of claim 13 wherein the hydrogen-donor solvent contains at least 0.8 wt % donatable hydrogen.

19. The process of claim 13 wherein the hydrogen-donor solvent contains from about 1.2 to about 3.0 wt % donatable hydrogen.

20. The process of claim 13 wherein the liquefaction is accomplished in the presence of molecular hydrogen.

21. The process of claim 13 wherein the liquefaction is accomplished at a pressure within the range from about 2000 to about 2500 psig.

22. The process of claim 13 wherein the liquefaction is accomplished at a temperature within the range from about 800° to about 880° F.

23. The process of claim 13 wherein the coal is a bituminous coal.

24. The process of claim 13 wherein the coal is a subbituminous coal.

25. The process of claim 13 wherein the naphtha yield is controlled by controlling the pressure, the nominal holding time and the amount of bottoms recycle in accordance with the following equation:

$$Y_{naphtha} = k_1(1 - e^{-k_2\phi}) + C_1\left(\frac{B}{SC}\right) + C_2 + k_3(1 - e^{-k_4\phi})PC_3N$$

wherein:

$Y_{naphtha}$ = the yield of $C_3$-400° F. boiling range naphtha in wt % based on solid carbonaceous material;

$k_1(1-e^{-k_2\phi})$ = the yield of naphtha via conversion of solid carbonaceous material; $k_1$ and $k_2$ are reaction rate constants which vary with the solid carbonaceous material and $\phi$ is the holding time at liquefaction conditions;

$C_1(B/SC)$ = the yield of naphtha via conversion of bottoms; $C_1$ is a constant which varies with solid carbonaceous material and B/SC is the ratio of recycle bottoms to fresh solid carbonaceous material fed to liquefaction;

$k_3(1-e^{-k_4\phi})$ = yield of naphtha via conversion of solvent; $k_3$ and $k_4$ are reaction rate constants which vary with solid carbonaceous material and $\phi$ is the holding time at liquefaction conditions;

P = the pressure during liquefaction;

$C_3$ = a constant which varies with the particular solid carbonaceous material; and N = concentration of naphthenic components in the solvent.

* * * * *